United States Patent [19]

Kovasna

[11] Patent Number: 4,742,655

[45] Date of Patent: May 10, 1988

[54] DEVICE IN CONCRETE STRUCTURES

[75] Inventor: Lars P. Kovasna, Bromma, Sweden

[73] Assignee: KaBe Industrier AB, Sweden

[21] Appl. No.: 940,759

[22] PCT Filed: Mar. 24, 1986

[86] PCT No.: PCT/SE86/00129

§ 371 Date: Nov. 19, 1986

§ 102(e) Date: Nov. 19, 1986

[87] PCT Pub. No.: WO86/05830

PCT Pub. Date: Oct. 9, 1986

[30] Foreign Application Priority Data

Mar. 29, 1985 [SE] Sweden ..... 8501581

[51] Int. Cl.[4] ..... E04B 1/41

[52] U.S. Cl. ..... 52/98; 52/62; 52/364; 52/699; 52/710; 52/583

[58] Field of Search ..... 52/577, 576, 98, 62, 52/99, 100, 127.3, 583, 710, 364, 699; 249/217

[56] References Cited

U.S. PATENT DOCUMENTS

| | | | |
|---|---|---|---|
| 420,731 | 2/1890 | Pajeau | 52/100 |
| 2,838,822 | 6/1958 | Kenney | 52/699 |
| 3,123,939 | 3/1964 | Erickson | 52/100 |
| 3,319,384 | 5/1967 | Berg | 52/100 |
| 3,430,408 | 3/1969 | Dean | 52/699 |
| 3,488,881 | 1/1970 | Holzer | 446/95 |
| 3,512,318 | 5/1970 | Turner | 52/100 |
| 3,548,554 | 12/1970 | Spanel | 52/705 |
| 3,667,174 | 6/1972 | Arnett | 52/710 |
| 3,707,815 | 1/1973 | Molyneux | 52/710 |
| 3,742,661 | 7/1973 | Tye | 52/705 |
| 3,974,619 | 8/1976 | Turner | 52/364 |
| 4,117,643 | 10/1978 | Lamothe | 52/699 |
| 4,123,889 | 11/1978 | Deloupy | 52/100 |

FOREIGN PATENT DOCUMENTS

| | | | |
|---|---|---|---|
| 889043 | 12/1971 | Canada | 52/699 |
| 0055321 | 7/1982 | European Pat. Off. . | |
| 2435139 | 2/1975 | Fed. Rep. of Germany | 52/100 |
| 3105889 | 11/1982 | Fed. Rep. of Germany . | |
| 3127087 | 1/1983 | Fed. Rep. of Germany . | |
| 3201918 | 8/1983 | Fed. Rep. of Germany . | |
| 3220847 | 12/1983 | Fed. Rep. of Germany . | |
| 3222375 | 12/1983 | Fed. Rep. of Germany . | |
| 1025607 | 4/1953 | France | 52/100 |
| WO83/02128 | 6/1983 | PCT Int'l Appl. . | |
| WO84/02369 | 6/1984 | PCT Int'l Appl. . | |
| 669750 | 4/1952 | United Kingdom | 52/100 |
| 683816 | 12/1952 | United Kingdom | 52/98 |
| 943679 | 12/1963 | United Kingdom | 52/100 |

*Primary Examiner*—John E. Murtagh

*Attorney, Agent, or Firm*—Paul & Paul

[57] ABSTRACT

There is described a one-piece, elongated, hollow plastic section which is useful in the support of reinforcing steel in the casting of concrete structures and the formation of recesses in said structures. The section has a trapezoidal configuration and includes (1) a pair of converging wall portions, (2) a wall portion connecting said converging wall portions at their converging ends and (3) a covering strip portion parallel to said connecting wall portion and connecting the opposite ends of said converging wall portions, said (2) connecting wall portion having areas of reduced thickness formed therein and adapted to be perforated by rigid members whereby said wall portion is self-sealing at the area of perforation, said (3) covering strip portion having reduced thickness areas formed therein adjacent to the converging wall portions whereby said covering strip portion may be manually removed from said trapezoidal cross-section so as to form an elongated, U-shaped plastic device.

1 Claim, 2 Drawing Sheets

Fig. 1
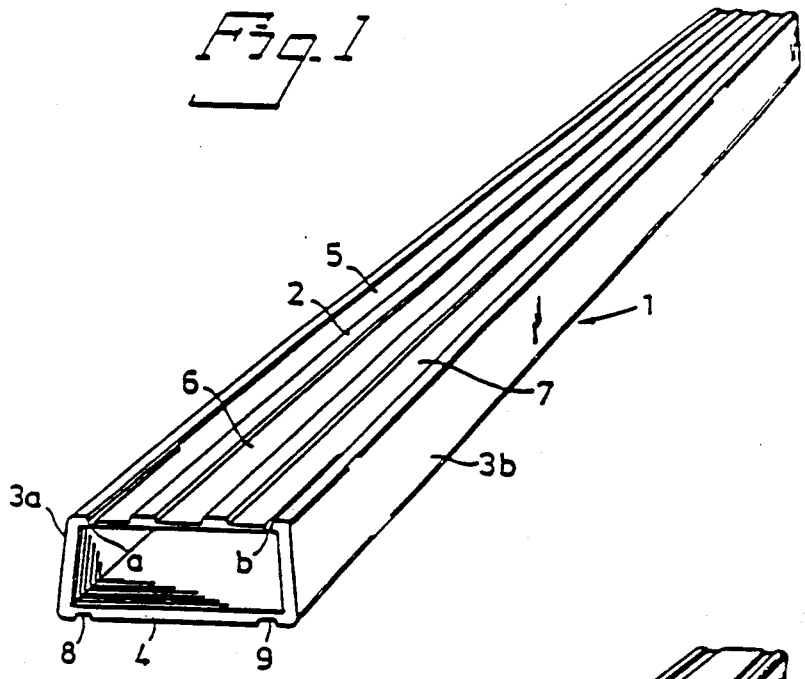
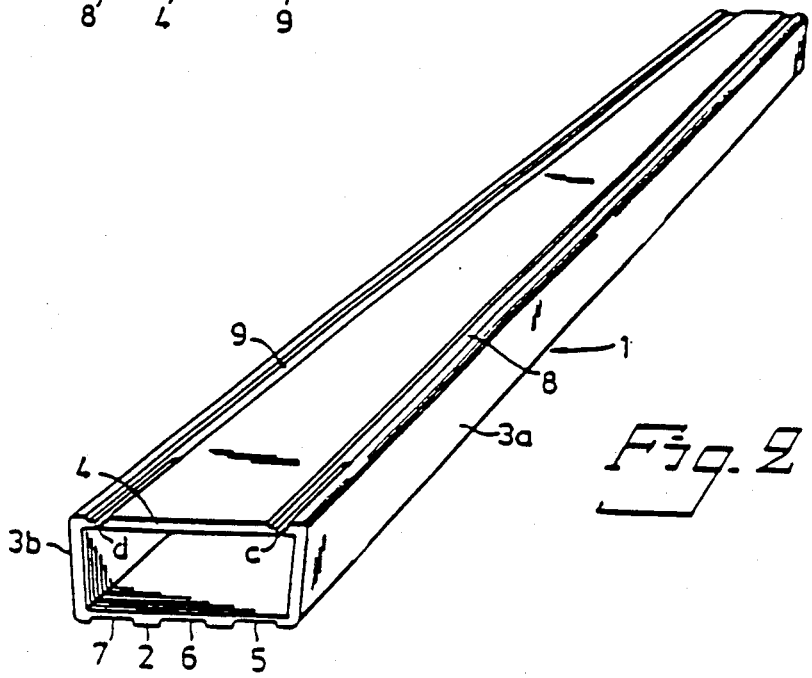
Fig. 2

DEVICE IN CONCRETE STRUCTURES

DESCRIPTION

1. Technical Field

The present invention relates to a device in concrete structures cast in situ, more specifically to a device for making recesses in a concrete structure during casting and for the protection of reinforcing steel intended to connect this concrete structure with at least one further concrete structure, the device including a section which may be cast into the first-mentioned concrete structure, the section having a covering strip and together therewith forming a space accommodating reinforcing steel extending through one wall of the section.

2. Background Art

Casting joints are formed in concrete structures cast in situ, such as walls, floors and arches. Reinforcement must be arranged at each joint for uniting the structures to each other. The part of the reinforcement which is to be cast into the structure which will later be connected to an already cast structure must be protected against running cement and concrete so that the adhesion capacity of the reinforcement will not be spoiled. Apart from splicing reinforcement, recesses must be arranged to obtain better co-action between the structures and to increase the ability of the joints to take up lateral forces.

Different devices are known for providing both protection for reinforcement and recesses.

Such a known device comprises two wooden battens with fibre-board nailed to them which are nailed to the shuttering so that a space is formed between the battens, fibreboard and shuttering. After making holes in the fibreboard, bent reinforcing bars are inserted through the holes so that parts thereof project into the shuttering of the structure which is to be cast and other parts thereof are accommodated in the mentioned space. After casting the structure, the battens and fibre board are removed leaving a recess in the structure. Before a further contiguous structure is cast the reinforcing bars are bent out from the recess so that they project into the formwork of the new structure.

The salient disadvantage with the device just described is that it is fabricated by hand, and will thus be expensive as well as inferior, inter alia with regard to strength, protection of the reinforcing and sealing round it. Another disadvantage is that it is difficult to demolish.

Another device is manufactured by Betomax GmbH, Neuss, West Germany, and is marketed under the trade name COMAX Reinforcing Joints. This comprises a strip of expanded metal, which together with a plastics strip, which may be torn from it, defines a space in which the free legs of reinforcing stirrups are inserted. The legs are inserted through and welded in holes in the strip and their stirrup-shaped parts project at right angles from it.

In the use of this device the builder must use the reinforcement which is already put in during fabrication of the device and which often does not agree with what the designer has intended, and which furthermore may be in conflict with applicable codes of practice in some cases. This means that new calculations and drawings must be made, where dimensioning of reinforcement and its placing must be adjusted to the strip and not vice versa. The expanded metal remains in the concrete structure and in general does not get a sufficiently thick covering layer of concrete, resulting in that the whole device including remaining reinforcement begins to rust, whereby the aging resistance of the concrete deteriorates considerably.

A still further known device designated HALFENEISEN Jointing Section HBT comprises a sheet metal section of U-shaped cross section with holes through which the reinforcement projects. Together with a sheet metal strip removable from it the section defines a space for parts of the reinforcement while remaining parts of the reinforcement projects out at right angles from the opposite side of the section.

This device is burdened with substantially the same disadvantages as those already described in connection with the device manufactured by Botomax GmbH. After casting, the strip is first torn off, which is troublesome due to the section being stiff, and then the section is removed, which requires a preparatory, accurate straightening of the parts which were accommodated by the section so that they extend in the same direction as its remaining parts.

From the patent specification Nos. DE, A1, 3 127 087, DE, A1 3 222 375 and EP, A1, 0 055 321 there are known devices, each of which comprises a section with a covering strip, which are manufactured from plastics and with the aid of which the above-mentioned disadvantages with the described devices are mitigated to a certain extent. The devices according to the three last-mentioned publications are all burdened with two important disadvantages, however. The one is that the devices are not made as closed sections, resulting in that manufacture will be expensive and complicated, and that necessary connection means between section and covering strip must be acted on at different occasions during use. The other disadvantage is that the holes in the section through which the reinforcing bars are insertable are already made, resulting in that a reinforcing bar thickness determined before manufacturing the device is intended, which in turn results in that a plurality of different devices with differently large holes must be manufactured and stored if reinforcing bars of different thicknesses are required.

DISCLOSURE OF INVENTION

It is an object of the present invention at least to partially remove the disadvantages with the previously known devices and to provide a device which is cheap to manufacture and simple to use, which is easily adaptable to different conditions at the site where casting takes place and which provides good sealing between it and the reinforcement. The covering strip of the device is easily torn off from it without using tools, and the basic section of the device is easily removable from the cast concrete structure.

These and other objects and advantages of the device in accordance with the invention are provided by the device having been given the distinguishing features disclosed in the characterizing portions of the claim.

This invention comprises an elongated, hollow, one-piece, self-supporting plastic device having a trapezoidal cross-section, which cross-section comprises (1) a pair of converging wall portions, (2) a wall portion connecting said converging wall portions at their converging ends and (3) a covering strip portion parallel to said connecting wall portion and connecting the opposite ends of said converging wall portions, said (2) connecting wall portion having areas of reduced thickness formed therein and adapted to be perforated by rigid members whereby said wall portion is self-sealing at the area of perforation, said (3) covering strip portion having reduced thickness areas formed therein adjacent to the converging wall portions whereby said covering strip portion may be manually removed from said trapezoidal cross-section so as to form an elongated, U-shaped plastic device.

DESCRIPTION OF FIGURES

FIG. 1 is an oblique perspective view from above of a device in accordance with the invention.

FIG. 2 is an oblique perspective view seen from below of the device in FIG. 1.

PREFERRED EMBODIMENT

Figure 3:
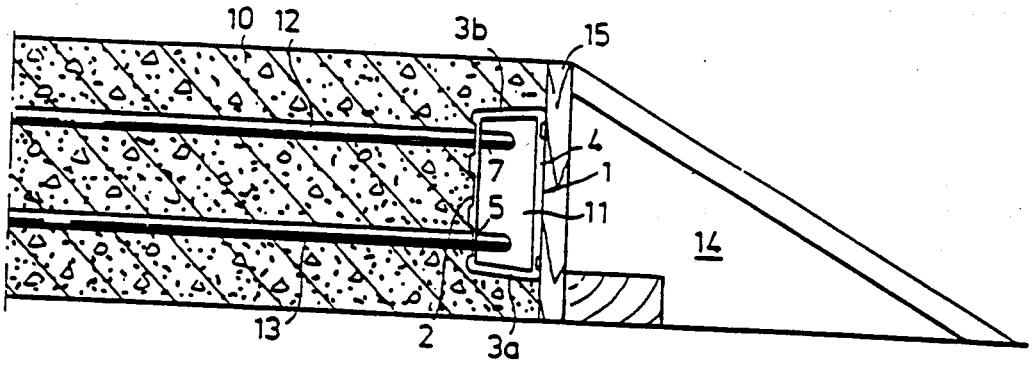
FIGS. 3 and 4 are schematic cross sections illustrating the use of the device of FIGS. 1 and 2 in two different concrete structures.

The device illustrated in FIGS. 1 and 2 comprises a hollow section, trapezoid-shaped in cross section, i.e. with two parallel sides, and is integrally manufactured by extrusion moulding a polyolefin-based plastics material. The section has been cut to a length suited to a desired storey height, i.e. 2,400–3,000 mm, its width is about 55 mm on one parallel side and about 50 mm on the other parallel side, and its thickness is about 25 mm. The general width of the section as well as the width and location of the thickness reductions described below are adapted such that with the least possible dimensions the section will suit all concrete construction dimensions and the thickness of the concrete covering layer according to concrete construction codes of practice. The thickness of the section is selected such that it supports its own weight including reinforcement and retains its shape during casting.

The section 1 may be said to comprise a substantially U-shaped portion with walls 2, 3*a*, 3*b* and a flat coverting strip portion 4. The wall 2 is provided with three longitudinal reductions 5, 6, 7 in thickness. The width of each reduction is about 10 mm and each of the portions between the reductions is about 7 mm wide. At the junction between walls 3*a* and 3*b* the covering strip portion 4 has longitudinal thickness reductions 8 and 9. The wall 2 may optionally be provided with colour or other markings, e.g. at 50 mm spacing in the longitudinal direction of the section.

The use of the section 1 described above and illustrated in FIGS. 1 and 2 will now be described in conjunction with FIGS. 3 and 4.

A concrete structure 10 is illustrated in FIG. 3, and may be a wall, a flooring slab or a floor. The structure 10 is provided with a recess 11, achieved by use of the device 1 in accordance with the invention, as well as reinforcing bars 12 and 13. A part of the formwork for the structure 10 is denoted by 14 and includes a shuttering wall 15.

In connection with installing the shuttering wall 15 illustrated in FIG. 3, and after determining how many reinforcing bars are to be used, their dimension, mutual spacing and location, the wall 2 is perforated at selected, possibly premarked, places at one or more of the reductions 5–7 with the aid of the reinforcing bars, by the ends thereof being forced by the operator into and through the plastics material. The holes thus obtained accordingly automatically obtain the same diameter as the reinforcing bars, and the hole edges and the bars will seal against each other independent of the diameter of the bar. After perforation, each bent reinforcing bar is swung so that its leg with the perforating end will be substantially parallel to the longitudinal direction of the section, whereafter this leg is forced into the section until the other leg of the bar comes into engagement against the hole.

Before or after the insertion of the reinforcing bars in the section 1 the ends of the section are provided with closing covers (not shown), or a slit some centimeters long (indicated at a and b in FIG. 1) is made at the ends of the section between the wall 2 and walls 3*a* and 3*b* so that a flap of the wall 2 is formed. When the section and associated reinforcing bars are nailed to the shuttering wall 15 with the cover strip engaging against it, the flap is bent against the strip 4 and nailed to it and the wall 15, thus closing off the ends of the section.

After the formwork has been filled with concrete, which then cures to form the structure 10 with the recess 11 and reinforcement 12, 13 thrusting into the structure, the formwork 14 is removed. A slit some centimeters long (indicated at c and d in FIG. 2) is made between the wall 3*a* and the strip 4 as well as between the wall 3*b* and strip 4 along the reductions 8 and 9, thus forming a flap. The flap is then gripped by the operator and pulled towards the opposite end of the section, thus removing the strip 4 from the section 2, 3*a*, 3*b* along the reductions 8, 9 while the section 2, 3*a*, 3*b* remains attached to the structure 10. After the reinforcing bars have been bent back to be substantially straight, and slits possibly made between the holes for the reinforcing bars, the section 2, 3*a* 3*b* is removed from the structure, which is facilitated by the walls 3*a* and 3*b* being convergent.

Figure 4:
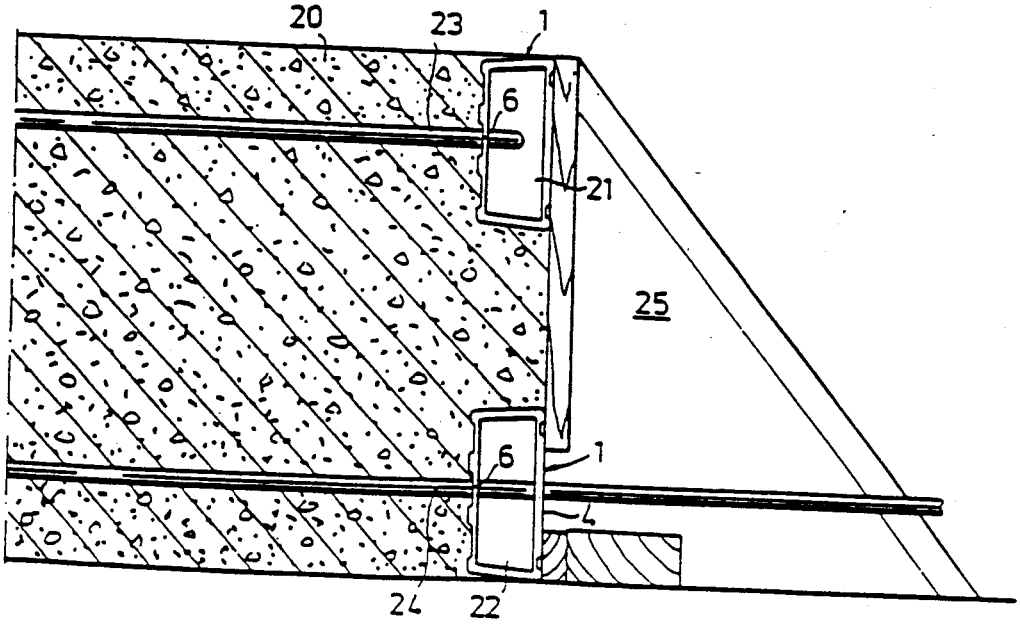

Another structure 20 is illustrated in FIG. 4, in which two sections 1 are used to form two recesses 21 and 22. In the section for the upper recess 21, bent reinforcing bars 23 have perforated the center reduction 6, as different from what is shown in FIG. 3 where the reductions 5 and 7 are perforated. In the section for the lower recess 22 a long straight reinforcing bar 24 has penetrated the reduction 6 as well as the strip 4. In this case the section does not constitute protection for the reinforcing bar during casting, but serves to provide the recess as well as support and sealing for the reinforcing bars during casting. After casting and removal of the formwork 24 surrounding the structure 20, the upper section is removed in the manner described above in connection with FIG. 3, while the lower section is removed by first cutting slits in the strip 4 between the holes and therefore tearing the strip away from the section 2, 3*a*, 3*b* along the reductions 8, 9, after which the section is removed in the manner described above in connection with FIG. 3.

Although only one embodiment of the invention is described above and illustrated on the drawings it will be understood that the invention is not limited to this embodiment but only restricted by the disclosures in the claim.

I claim:

1. An elongated, hollow, one-piece, self-supporting plastic device having a trapezoidal cross-section, which cross-section comprises (1) a pair of converging wall portions, (2) a wall portion connecting said converging wall portions at their converging ends and (3) a covering strip portion parallel to said connecting wall portion and connecting the opposite ends of said converging wall portions, said (2) connecting wall portion having areas of reduced thickness formed therein and adapted to be perforated by rigid members whereby said wall portion is self-sealing at the area of perforation, said (3) covering strip portion having reduced thickness areas formed therein adjacent to the converging wall portions whereby said covering strip portion may be manually removed from said trapezoidal cross-section so as to form an elongated, U-shaped plastic device.

* * * * *